US008651166B1

(12) United States Patent
Daniels

(10) Patent No.: US 8,651,166 B1
(45) Date of Patent: Feb. 18, 2014

(54) ADJUSTABLE ROLLER SHADE

(76) Inventor: Joseph J. Daniels, Roslyn Heights, NY (US)

( * ) Notice: Subject to any disclaimer, the term of this patent is extended or adjusted under 35 U.S.C. 154(b) by 199 days.

(21) Appl. No.: 13/098,879

(22) Filed: May 2, 2011

Related U.S. Application Data

(60) Provisional application No. 61/331,082, filed on May 4, 2010.

(51) Int. Cl.
*A47H 1/00* (2006.01)

(52) U.S. Cl.
USPC ..... 160/250; 160/263; 160/238

(58) Field of Classification Search
USPC ..... 160/238, 250, 263, 323.1, 23.1; 248/200.1, 264, 268, 269, 257; 242/376, 407.1, 609.1; 403/109.1, 292, 403/298
See application file for complete search history.

(56) References Cited

U.S. PATENT DOCUMENTS

| | | | | |
|---|---|---|---|---|
| 651,611 | A | 6/1900 | Reid | |
| 728,424 | A | 5/1903 | Steffee | |
| 1,067,708 | A | 7/1913 | Anderson et al. | |
| 1,070,042 | A | 8/1913 | Kottkay | |
| 1,238,931 | A | 9/1917 | Murray | |
| 1,356,237 | A | 10/1920 | Szefczyk | |
| 2,297,483 | A * | 9/1942 | Kuhne | 403/224 |
| 2,615,516 | A | 10/1952 | Hyde | |
| 3,186,474 | A | 6/1965 | Levitas | |
| 3,203,468 | A * | 8/1965 | Gossling et al. | 160/323.1 |
| 3,220,523 | A | 11/1965 | Hepner | |
| 3,299,944 | A * | 1/1967 | Gossling et al. | 160/263 |
| 3,308,874 | A * | 3/1967 | Anderson | 160/326 |
| 3,315,728 | A * | 4/1967 | Anderson et al. | 160/326 |
| 3,340,922 | A * | 9/1967 | Anderson | 160/326 |
| 3,389,738 | A | 6/1968 | Roth | |
| 3,515,417 | A * | 6/1970 | Bowman | 403/366 |
| 3,521,694 | A * | 7/1970 | Anderson | 160/323.1 |
| 3,580,323 | A | 5/1971 | Gossling | |
| 4,006,770 | A | 2/1977 | Ferguson | |
| 4,092,775 | A | 6/1978 | Erpenbeck | |
| 4,114,266 | A | 9/1978 | Erpenbeck | |
| 4,157,108 | A * | 6/1979 | Donofrio | 160/263 |
| 4,223,714 | A | 9/1980 | Weinreich et al. | |

(Continued)

FOREIGN PATENT DOCUMENTS

| | | |
|---|---|---|
| CA | 2306244 | 10/2001 |
| CN | 2349933 Y | 11/1999 |

(Continued)

OTHER PUBLICATIONS

International Search Report corresponding to International Application No. PCT/US2010/059679 mailed Apr. 26, 2011.

(Continued)

*Primary Examiner* — Katherine Mitchell
*Assistant Examiner* — Johnnie A Shablack
(74) *Attorney, Agent, or Firm* — Amster, Rothstein & Ebenstein, LLP

(57) ABSTRACT

A roller shade assembly comprises a tubular roller having a generally cylindrical internal cavity, an generally tubular extension telescopically mounted within the internal cavity of the roller tube, and an outer tube mounted over the extension. The extension includes an outer wall and a plurality of winged splines located around the outer circumference of the outer wall which extend along at least a portion of the length of the extension tube.

8 Claims, 5 Drawing Sheets

(56) References Cited

U.S. PATENT DOCUMENTS

| | | | | |
|---|---|---|---|---|
| 4,323,105 | A | 4/1982 | Berman | |
| 4,372,432 | A | 2/1983 | Waine et al. | |
| 4,403,415 | A | 9/1983 | Kufrin | |
| RE31,793 | E | 1/1985 | Berman et al. | |
| 4,539,238 | A | 9/1985 | Markowitz | |
| 4,619,305 | A * | 10/1986 | Comeau | 160/263 |
| 4,636,106 | A * | 1/1987 | Waisbrod | 403/228 |
| 4,865,109 | A | 9/1989 | Sherman | |
| 5,016,701 | A | 5/1991 | Vore | |
| 5,203,395 | A | 4/1993 | Koller et al. | |
| 5,375,643 | A | 12/1994 | Rude | |
| 5,505,418 | A | 4/1996 | Corcoran | |
| 5,507,374 | A | 4/1996 | Rude | |
| 5,566,741 | A | 10/1996 | Ogawara et al. | |
| 5,791,393 | A | 8/1998 | Judkins | |
| 5,881,792 | A | 3/1999 | Cheng | |
| 6,019,864 | A | 2/2000 | Jones | |
| 6,158,563 | A | 12/2000 | Welfonder et al. | |
| 6,173,825 | B1 | 1/2001 | Liu | |
| 6,196,508 | B1 | 3/2001 | Nijs | |
| 6,234,235 | B1 | 5/2001 | Ming | |
| 6,460,593 | B1 | 10/2002 | Floyd | |
| 6,510,566 | B2 | 1/2003 | Bryce | |
| 6,615,895 | B2 | 9/2003 | Marocco | |
| 6,644,379 | B1 | 11/2003 | Nei | |
| 6,685,592 | B2 | 2/2004 | Fraczek et al. | |
| 6,758,257 | B2 | 7/2004 | Lee | |
| 6,845,955 | B1 | 1/2005 | Hsu | |
| 6,880,607 | B2 | 4/2005 | Marocco | |
| 6,931,970 | B2 | 8/2005 | Cheng | |
| 6,935,401 | B2 | 8/2005 | Fraczek et al. | |
| 7,100,668 | B2 | 9/2006 | Allsop | |
| 7,118,028 | B2 | 10/2006 | Liu et al. | |
| 7,240,716 | B2 | 7/2007 | Nichols, Jr. et al. | |
| D557,117 | S | 12/2007 | Cannaverde | |
| 7,325,696 | B2 | 2/2008 | Matthew et al. | |
| 7,387,150 | B2 | 6/2008 | Liu | |
| 7,621,313 | B2 | 11/2009 | Pham | |
| 7,836,937 | B2 | 11/2010 | Anderson et al. | |
| 7,886,418 | B2 | 2/2011 | Birch et al. | |
| 2001/0039677 | A1 | 11/2001 | Bryce | |
| 2002/0069980 | A1 | 6/2002 | Floyd | |
| 2003/0136525 | A1 | 7/2003 | Marocco | |
| 2003/0178276 | A1 | 9/2003 | Fraczek et al. | |
| 2003/0205336 | A1 | 11/2003 | Marocco | |
| 2004/0003904 | A1 | 1/2004 | Fraczek et al. | |
| 2005/0011618 | A1 | 1/2005 | Kee | |
| 2005/0039866 | A1 | 2/2005 | Allsopp | |
| 2005/0087313 | A1 | 4/2005 | Nichols, Jr. et al. | |
| 2005/0184143 | A1 | 8/2005 | Liu et al. | |
| 2006/0137833 | A1 | 6/2006 | Nichols, Jr. et al. | |
| 2007/0056699 | A1 | 3/2007 | Liu | |
| 2007/0277657 | A1 | 12/2007 | Hilgendorf et al. | |
| 2008/0066283 | A1 | 3/2008 | Birch et al. | |
| 2008/0202709 | A1 | 8/2008 | Anderson et al. | |
| 2009/0126881 | A1 | 5/2009 | Chi et al. | |
| 2009/0242143 | A1 | 10/2009 | Pham | |

FOREIGN PATENT DOCUMENTS

| | | | |
|---|---|---|---|
| CN | 2349934 | Y | 11/1999 |
| CN | 2511215 | Y | 9/2002 |
| CN | 2538939 | Y | 3/2003 |
| CN | 2672266 | Y | 1/2005 |
| CN | 2709623 | Y | 7/2005 |
| CN | 201200280 | Y | 3/2009 |
| WO | 9605400 | | 2/1996 |
| WO | 03080981 | A2 | 10/2003 |

OTHER PUBLICATIONS

Written Opinion corresponding to International Application No. PCT/US2010/059679 mailed Apr. 26, 2011.

U.S. Appl. No. 12/635,290, filed Dec. 10, 2009.

U.S. Appl. No. 12/786,672, filed May 25, 2010.

U.S. Appl. No. 61/331,082, filed May 4, 2010, Confirmation No. 5789.

* cited by examiner

ADJUSTABLE ROLLER SHADE

CROSS-REFERENCE TO RELATED APPLICATIONS

This application claims priority to U.S. Provisional Patent Application No. 61/331,082, filed May 4, 2010 the content of which is incorporated herein by reference in its entirety.

FIELD

The present invention relates to window roller shades, and in particular to length adjustable roller shades.

SUMMARY

According to one embodiment, a roller shade assembly comprises: a tubular roller having a generally cylindrical internal cavity; a generally tubular extension telescopically mounted within the internal cavity of the roller, wherein the extension comprise an outer wall and a plurality of winged splines located around the outer circumference of the outer wall which extend along at least a portion of the length of the extension; and an outer cardboard tube mounted over the extension.

In at least one embodiment, each of the winged splines comprises first and second members splayed outward in opposing directions from a common center point on the outer wall.

In at least one embodiment, the first and second members have a curved cross-sectional contour.

In at least one embodiment, the first and second members are substantially resiliently flexible.

In at least one embodiment, the resiliently flexible first and second members provide for a tight frictional fit that resists lengthwise movement and relative rotation between the extension and the roller, while allowing the extension to slide lengthwise within the roller when under compressive force.

In at least one embodiment, the resiliently flexible first and second members allows for the extension to be adaptable for insertion into rollers of varying diameters.

In at least one embodiment, the plastic extension is substantially rigid along its length to provide stability to the outer tube.

In at least one embodiment, the roller and the outer tube define a substantially continuous single-diameter contour.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION

Figure 1:
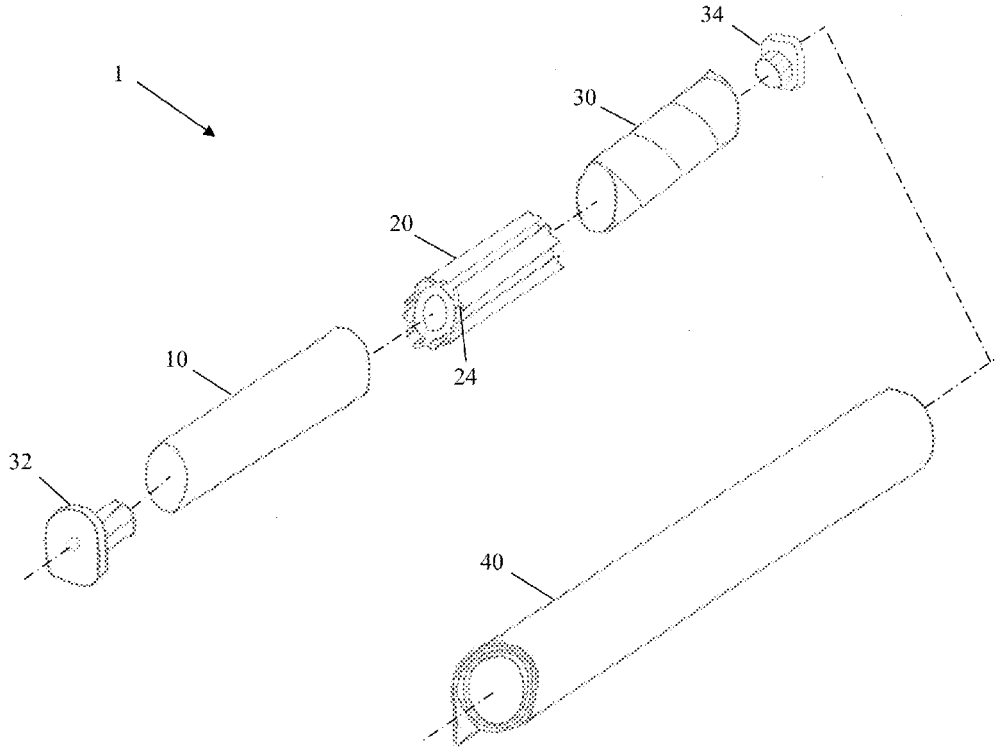
FIG. 1 is an exploded view of the roller shade assembly according to an example embodiment.

The description hereinafter describes exemplary embodiments of a telescoping, cut-to-size roller shade system in conjunction with the accompanying figures. Where possible, like numerals are used to denote like components.

Referring to FIGS. 1-5, the roller shade system, generally designated by reference number 1, includes a hollow, tubular roller 10 that extends for the majority of the length of the shade. A generally tubular extension 20 is telescopically inserted into one end of the roller 10 to extend the length of the roller 10 to match the length of the shade. The portion of the extension 20 that extends beyond the roller 10 is surrounded by an outer tube 30, which may be fixed or rotatable relative to the extension 20. The extension 20 acts to provide strength and stability to the outer tube 30. The diameter of the outer tube 30 and the roller 10 are approximately the same, thereby providing a continuous single-diameter contour along the length of the shade. A fabric shade 40 is wrapped around the fully assembled roller assembly.

Figure 2:
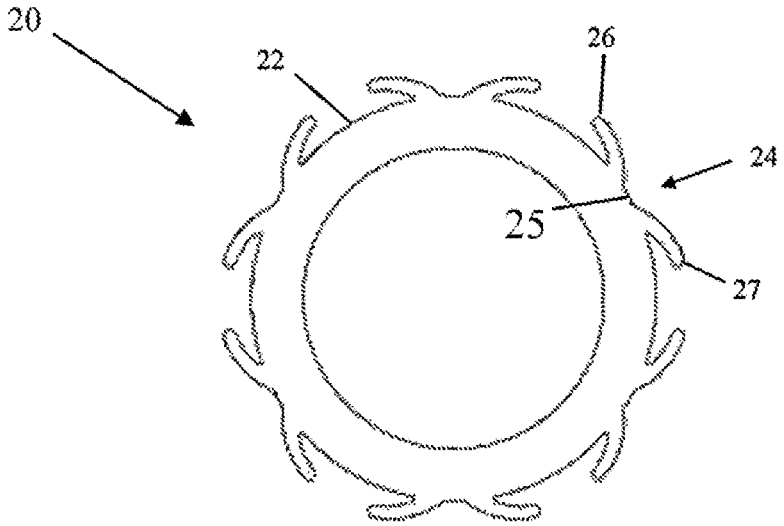
FIG. 2 is cross-section of an extension for the roller according to an example embodiment.

FIG. 2 is a cross-sectional view of the extension according to an example embodiment. According to this embodiment, the extension 20 includes an outer wall 22 of a generally uniform thickness and a plurality of winged splines 24 located around the outer circumference. The splines 24 can extend substantially along the entire length of the extension 20, but may also extend along only a portion thereof. Each spline 24 comprises first and second members 26, 27 splayed outward from a common center point 25 on the outer wall 22.

The first and second members 26, 27 are designed to be resiliently flexible, which provides for a tight frictional fit that resists lengthwise movement and relative rotation between the extension 20 and the roller 10, while still allowing the extension 20 to slide lengthwise within the roller 10 when under deliberate, intentionally-applied compressive forces. The flexibility of the first and second members 26, 27 also allows the extension 20 to be inserted into rollers 10 of varying diameters. Factors contributing to the flexibility of the first and second members 26, 27 may include the type of material used, the thickness, and the curved contour of the members.

The roller 10 may be formed from a sturdy, rigid material, such as plastic, metal or the like. The extension 20 may be formed from a sturdy material, such as plastic, an elastomer, metal or the like. For example, the extension 20 may be an extruded tube of chlorinated polyvinyl chloride (CPVC) type thermoplastic, UL rated 94VO so as to provide sufficient structural rigidity for the outer wall 22 and flexibility for the splines 24. The outer tube 30 may be formed from cardboard, plastic, an elastomer, sheet metal or the like. For example, the outer tube 30 may be made of a thin layer of cardboard or plastic for reasons of economy, ease of manufacturing, and ease of cutting to adjust to the appropriate length.

To adjust the length of the roller shade assembly, the outer tube 30 is measured to the necessary length and then placed in a window shade cutter, such as manufactured by Star Shade Cutter Co. Typically, the cutting blade of the shade cutter is fixed and the outer tube 30 is rotated such that the cutting blade moves around the outer tube 30. It is intended that the cutting blade slices off only the excess portion of the outer tube 30, and not the extension 20. The cutting blade may inadvertently make initial contact with the outer tips of the first and second members 26, 27 of the splines 24, yet given the structure of the extension 20, the splines 24 will act as a warning to the operator to stop the cutting operation. This allows the structural integrity and rigidity of the extension 20 to remain uncompromised after the cutting operation is complete. The extension 20 is preferably made from a softer material such as plastic or an elastomer, which will reduce or prevent damage from occurring to the cutting blade when cuts through the thin outer tube 30 and comes in contact with the more substantial extension 20.

Figure 3:
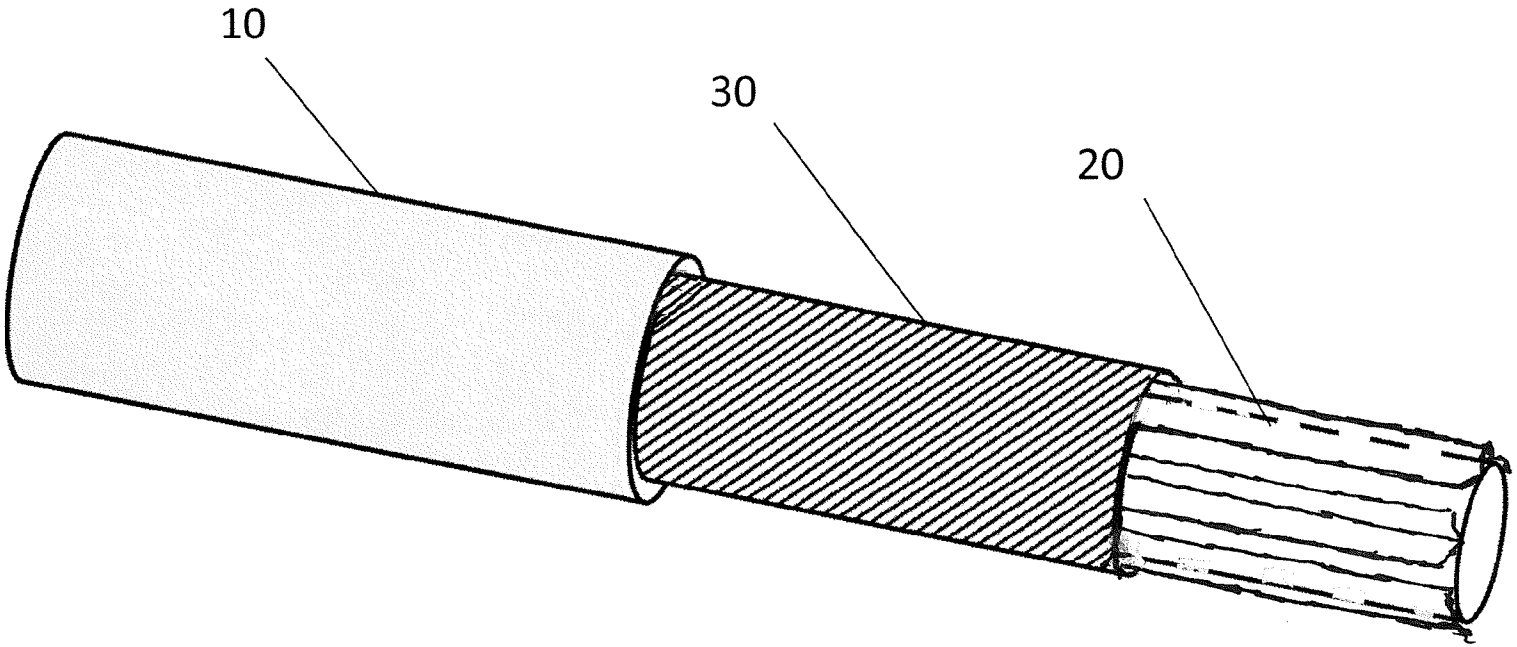
FIG. 3 is a perspective view showing the extension extending beyond the outer tube according to an example embodiment.
Figure 4:
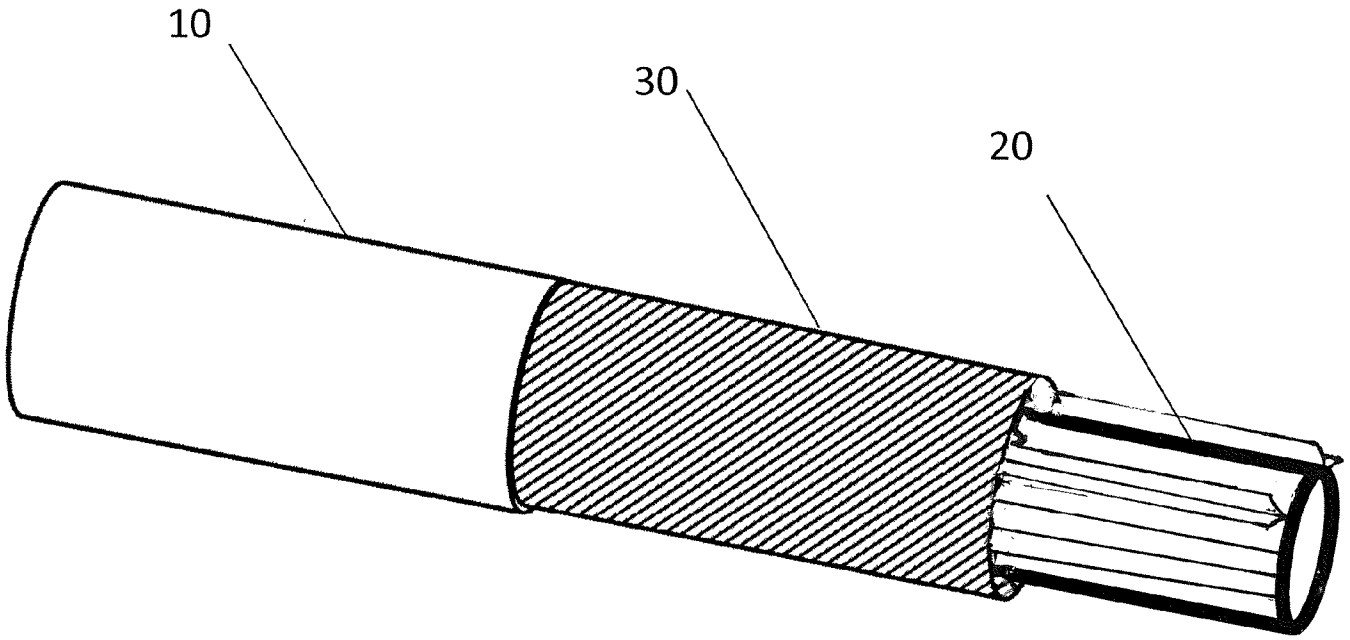
FIG. 4 is a perspective view showing the extension aligned flush with the outer tube according to an example embodiment.
Figure 5:
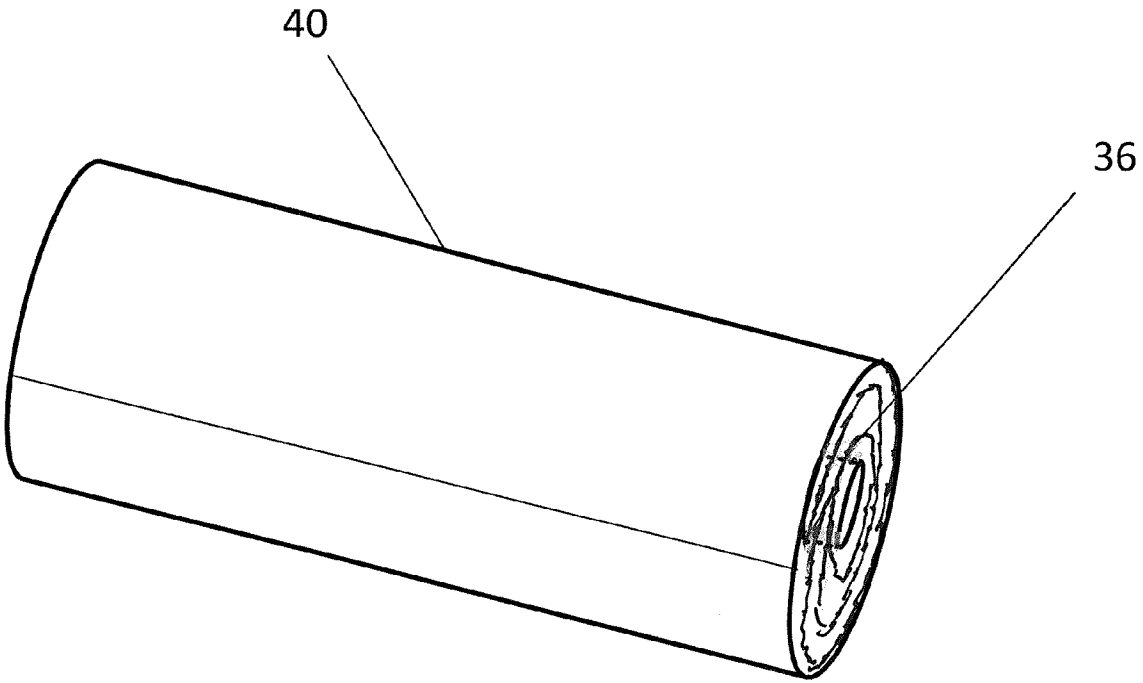
FIG. 5 is a perspective view of a fully assembled roller shade system according to an example embodiment.

After the outer tube 30 is cut to the appropriate length, a portion of the extension 20 will be left extending beyond the end of the outer tube such as shown in FIG. 3. The extension 20 can be slid further into the roller 10 until the end of the extension 20 is flush with the end of the outer tube 30 such as shown in FIG. 4. The fabric shade 40 is wrapped around the fully assembled roller shade assembly as shown in FIG. 5.

A clutch 32 and/or idler 34 may be inserted directly into the hollow cavities of the roller 10 and extension 20, respectively, in which case the inner surface defining the hollow cavities may be keyed to for rotational engagement with the clutch or idler such as shown in FIG. 1. A pin-bearing end cap 36 may alternatively be inserted into the hollow cavity at the exposed ends of the extension 20 in order to engage the roller shade assembly directly with a bracket that is used for mounting such as shown in FIG. 5.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A roller shade assembly comprising:

a metal, tubular roller having a generally cylindrical internal cavity;

a plastic, generally tubular extension telescopically mounted within the internal cavity of the metal roller tube, wherein the extension comprises:

an outer surface; and a plurality of winged splines located around the outer surface so that the plurality of winged splines extend along at least a portion of the length of the extension, each winged spline of the plurality of winged splines comprises first and second members that each form an acute angle with respect to the outer surface; and an outer cardboard tube mounted over the extension.

2. The roller shade assembly of claim 1, wherein each of the respective first and second members is splayed outward in opposing directions from a common center point on the outer surface.

3. The roller shade assembly of claim 1, wherein the first and second members have a curved cross-sectional contour.

4. The roller shade assembly of claim 1, wherein the plastic extension is substantially rigid along its length to provide stability to the outer tube.

5. The roller shade assembly of claim 1, wherein the roller and the outer tube define a substantially continuous single-diameter contour.

6. The roller shade assembly of claim 1, wherein the first and second members are substantially resiliently flexible.

7. The roller shade assembly of claim 6, wherein the resiliently flexible first and second members provide for a tight frictional fit that resists lengthwise movement and relative rotation between the extension and the roller, while allowing the extension to slide lengthwise within the roller when under compressive force.

8. The roller shade assembly of claim 6, wherein the resiliently flexible first and second members allows for the extension to be adaptable for insertion into rollers of varying diameters.

* * * * *